US007322811B2

(12) United States Patent
Schröter

(10) Patent No.: US 7,322,811 B2
(45) Date of Patent: Jan. 29, 2008

(54) APPARATUS FOR SPINNING AND WINDING MULTIFILAMENT YARNS

(75) Inventor: Michael Schröter, Remscheid (DE)

(73) Assignee: Saurer GmbH & Co. KG, Monchengladbach (DE)

( * ) Notice: Subject to any disclaimer, the term of this patent is extended or adjusted under 35 U.S.C. 154(b) by 312 days.

(21) Appl. No.: 11/049,012

(22) Filed: Feb. 2, 2005

(65) Prior Publication Data

US 2005/0129799 A1 Jun. 16, 2005

Related U.S. Application Data

(63) Continuation of application No. PCT/EP03/08228, filed on Jul. 25, 2003.

(30) Foreign Application Priority Data

Aug. 6, 2002 (DE) ..... 102 35 936

(51) Int. Cl.
*D01D 7/00* (2006.01)

(52) U.S. Cl. ..... 425/66; 425/DIG. 217; 425/DIG. 17; 425/72.2; 425/404; 425/464; 425/382.2

(58) Field of Classification Search ..... 425/462, 425/463, 464, 378.2, DIG. 217, DIG. 17, 425/404, 72.2, 382.2, 66
See application file for complete search history.

(56) References Cited

U.S. PATENT DOCUMENTS 3,844,496 A 10/1974 Rothert
4,774,042 A * 9/1988 Schippers ..... 264/103
5,661,880 A 9/1997 Schippers et al.
5,794,868 A 8/1998 Busenhart et al.
5,844,494 A * 12/1998 Spahlinger et al. ..... 340/677
5,891,284 A * 4/1999 Woodside et al. ..... 156/148
5,902,531 A * 5/1999 Berger et al. ..... 264/103
5,928,579 A 7/1999 Spahlinger et al.
6,120,715 A 9/2000 Weigend
6,210,143 B1 4/2001 Takagi et al.
6,406,650 B1 * 6/2002 Gross et al. ..... 264/103
6,447,703 B1 * 9/2002 Waddington et al. ..... 264/103
6,494,700 B1 * 12/2002 Stammen ..... 425/135

FOREIGN PATENT DOCUMENTS

DE 16 60 311 A 3/1972
EP 0 845 550 A1 6/1998
EP 940 485 A2 9/1999

* cited by examiner

*Primary Examiner*—Yogendra Gupta
*Assistant Examiner*—Maria Veronica Ewald
(74) *Attorney, Agent, or Firm*—Alston & Bird LLP

(57) ABSTRACT

An apparatus for spinning and winding a plurality of synthetic filament yarns, and which includes a spinning device, a withdrawal godet downstream of the spinning device, and a takeup device which has a plurality of winding positions that are distributed along a longitudinal axis. In the spinning device, a plurality of spinnerets are arranged in side-by-side relationship, each for spinning one yarn, and in the takeup device, each yarn is wound to a package at one of the winding positions. To provide a device that is compact and operator friendly, the spinning device and withdrawal godet are oriented in a transverse relationship with the longitudinal axis of the takeup device, and they are arranged in the region of the front end of the takeup device. With that, the distribution of the yarns from the spinning device to the winding positions can be readily accomplished.

16 Claims, 5 Drawing Sheets

APPARATUS FOR SPINNING AND WINDING MULTIFILAMENT YARNS

CROSS REFERENCE TO RELATED APPLICATION

The present application is a continuation of international application PCT/EP2003/008228, filed 25 Jul, 2003, and which designates the U.S. The disclosure of the referenced application is incorporated herein by reference.

BACKGROUND OF THE INVENTION

The present invention relates to an apparatus for spinning and winding a plurality of synthetic multi filament yarns.

Apparatus of this type for spinning and winding a plurality of synthetic filament yarns are generally known. They include a spinning device with a plurality of spinnerets, at least one withdrawal godet, and a takeup device with a plurality of winding positions. In the spinning device, a polymer melt is distributed by means of a melt producer to a plurality of spinnerets. In each of the spinnerets, the polymer melt is extruded under pressure to strandlike filament bundles, which are combined to a yarn after cooling. In this process, a withdrawal roll withdraws the yarns or filament bundles preferably together from the spinnerets and advances them to the winding positions of the takeup device. Within the apparatus, the yarns advance differently spaced from one another in accordance with the layouts of the individual devices.

For example, EP 0 845 550 and corresponding U.S. Pat. No. 5,928,579 disclose that the spacing between the yarns during the spinning, withdrawing, and winding operations is made different for each operation. Thus, the yarns advance on the withdrawal godet with a very small spacing between one another. While this enables a compact construction of the withdrawal godet, it has the disadvantage that the group of filaments must be combined upstream of the withdrawal godet and be spread downstream thereof. To this end, it is necessary to deflect the filaments, particularly at the outer regions of the group.

To avoid damage by reason of the large deflections and loopings, or to avoid different physical properties, it is known not to exceed certain limit values, when the filaments are deflected. In this connection, the deflection of the filaments is dependent on the spacing of the filaments in the spinning device and on the number of the filaments spun parallel in side-by-side relationship. In particular in the case of a large number of filaments, the problem of a greatly varying deflection arises, which is however limited because a too high looping friction is avoided. Only a correspondingly long zone between the spinning device and the withdrawal godet can reduce such deflections.

Likewise, the distance from the takeup device is predetermined by such limited deflections. As a consequence, the known apparatuses for spinning and winding a plurality of filament yarns require an installation height, which extends over several tiers. With that, however, it is possible to operate such apparatus, in particular for threading the yarns, only over several tiers. On the other hand, when combining the filament yarns downstream of the spinning device, the spacing between the yarns should not be selected too large in order to avoid that withdrawal godets project over a very great length. Furthermore, for cost and handling reasons, there arises the desire for keeping the overall height and the width of the apparatus within limits. However, this brings along the problem with having to exceed admissible limit values of the deflection in the guidance of the yarn.

It is an object of the invention to further develop an apparatus of the initially described type in such a manner that it permits realizing overall heights of the apparatus that are as small as possible even in the case of a large number of parallel spun yarns.

A further object of the invention is to make available an apparatus for producing a plurality of yarns, that is as compact and operator friendly as possible.

SUMMARY OF THE INVENTION

The above and other objects and advantages of the invention are achieved by the provision of a melt spinning device which distinguishes itself in particular in that the combining and spreading of the yarns occurs in differently oriented planes. The spreading and distribution of the group of yarns to the individual winding positions of the takeup device substantially occur in an approximately horizontally oriented distribution plane by including the depth of the apparatus for guiding the yarns. To this end, the spinning device and the withdrawal godet are oriented in a transverse relationship with the longitudinal axis of the takeup device and they are arranged at the front end of the takeup device. Thus, the withdrawal godet is directly adjacent the winding positions of the takeup device. It is thus possible to guide the yarns with advantage, first in a vertical spinning plane from the spinning device to the withdrawal godet, and to then guide them in a substantially horizontal distribution plane, which is transverse of the spinning plane, to the winding positions of the takeup device.

To enable an operator to receive the yarns from the spinning device after a spinning startup, and to thread them in downstream devices, the withdrawal godet of a very advantageous further development of the invention is associated with the outlet of a chute of the spinning device, and the withdrawal godet and the outlet of the chute are arranged on the operating side of the takeup device within the reach of an operator. Even in the case of a plurality of yarns, an operator is able to handle the yarns in a simple manner for inserting and threading them.

The outlet of the chute is preferably arranged at a distance of less than about 250 cm from a service platform. With that, a person is able to operate downstream of the chute all devices for guiding and treating the yarns, such as, for example, yarn lubrication devices and yarn sensors.

To be able to produce, for example, yarns with a preoriented and not fully drawn molecular structure, a preferred further development of the invention is very suitable, wherein a plurality of distributor rolls are arranged between the withdrawal godet and the winding positions of the takeup device. These distributor rolls separate the yarns advancing from the withdrawal godet for their entry into the winding positions. For example, after leaving the withdrawal godet, it is thus possible to guide the yarns to a plurality of distributor rolls, which are arranged in pairs or individually, one following the other in the longitudinal direction of the takeup device.

It is preferred to associate a distributor roll with each winding position of the takeup device. Thus, after leaving the withdrawal godet, the yarns undergo a distribution that is separated in accordance with the arrangement of the winding positions. Preferably, the distributor rolls are arranged directly upstream of an inlet yarn guide of the winding position, so that while advancing from the spinneret associated to the winding position, each yarn undergoes a deflection on the withdrawal godet and a deflection on the distributor roll. The looping ratios of each of the yarns are essentially the same, so that no significant yarn tension differences result from the distribution to the winding positions.

To adjust a winding tension, the distributor rolls of an advantageous further development are driven individually or in groups. With that, it is possible to adjust on the withdrawal godet, different circumferential speeds among the associated distributor rolls.

To perform additional treatment steps, the further development of the invention is especially suited, which includes in the path of the advancing yarn a second godet that is associated with the withdrawal godet. Thus, before being distributed to the winding positions, the yarns loop several times about the withdrawal godet and the second godet. With that, it is possible to realize in a simple manner a heat treatment, a drawing, or an entanglement of the yarns before they enter the winding positions.

To generate greater withdrawing forces while withdrawing the yarns from the spinning device, it is also advantageous to form the second godet by a driven guide roll, so that the withdrawal godet is able to apply greater withdrawal forces with a guide roll by looping the advancing yarn several times.

The devices provided downstream of the spinning device, in particular the withdrawal godet are advantageously mounted directly to a frame section of takeup device. Thus, the apparatus is essentially composed of components of the spinning device, which are mounted to a support forming a tier, and components of the takeup device, which are supported on the machine frame arranged on the service platform.

In the above arrangement, the electronic equipment for driving and controlling all components arranged on the machine frame of the takeup device can advantageously be combined to one constructional unit. Preferably, a control panel is associated to the constructional unit, which permits the operator controlling each of the controllable components.

BRIEF DESCRIPTION OF THE DRAWINGS

In the following further advantages of the invention are described in greater detail with reference to several embodiments shown in the attached Figures, in which.

DETAILED DESCRIPTION OF THE PREFERRED EMBODIMENTS

Figure 1:
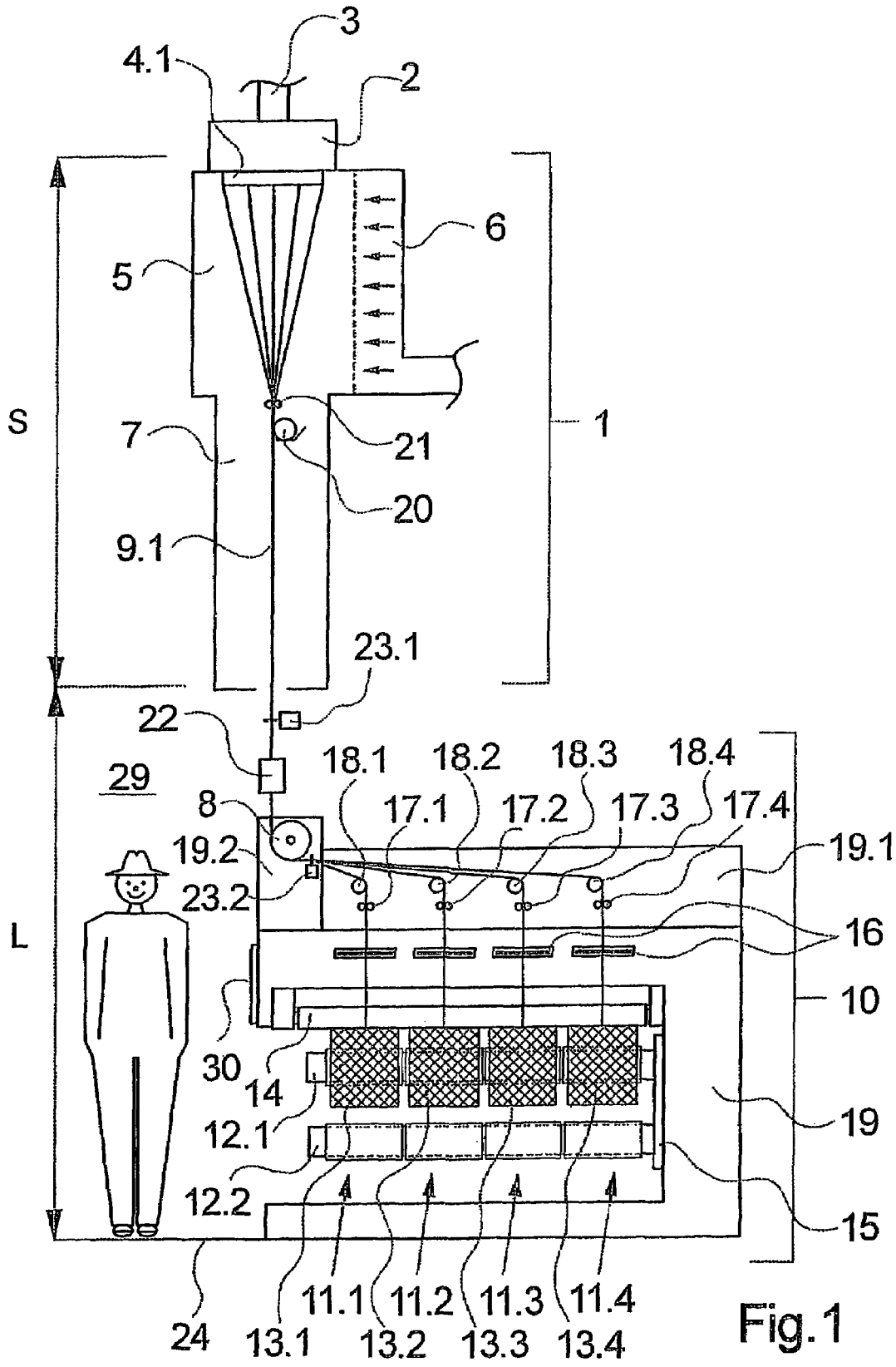
FIG. 1 is a schematic side view of a first embodiment of the apparatus according to the invention.
Figure 2:
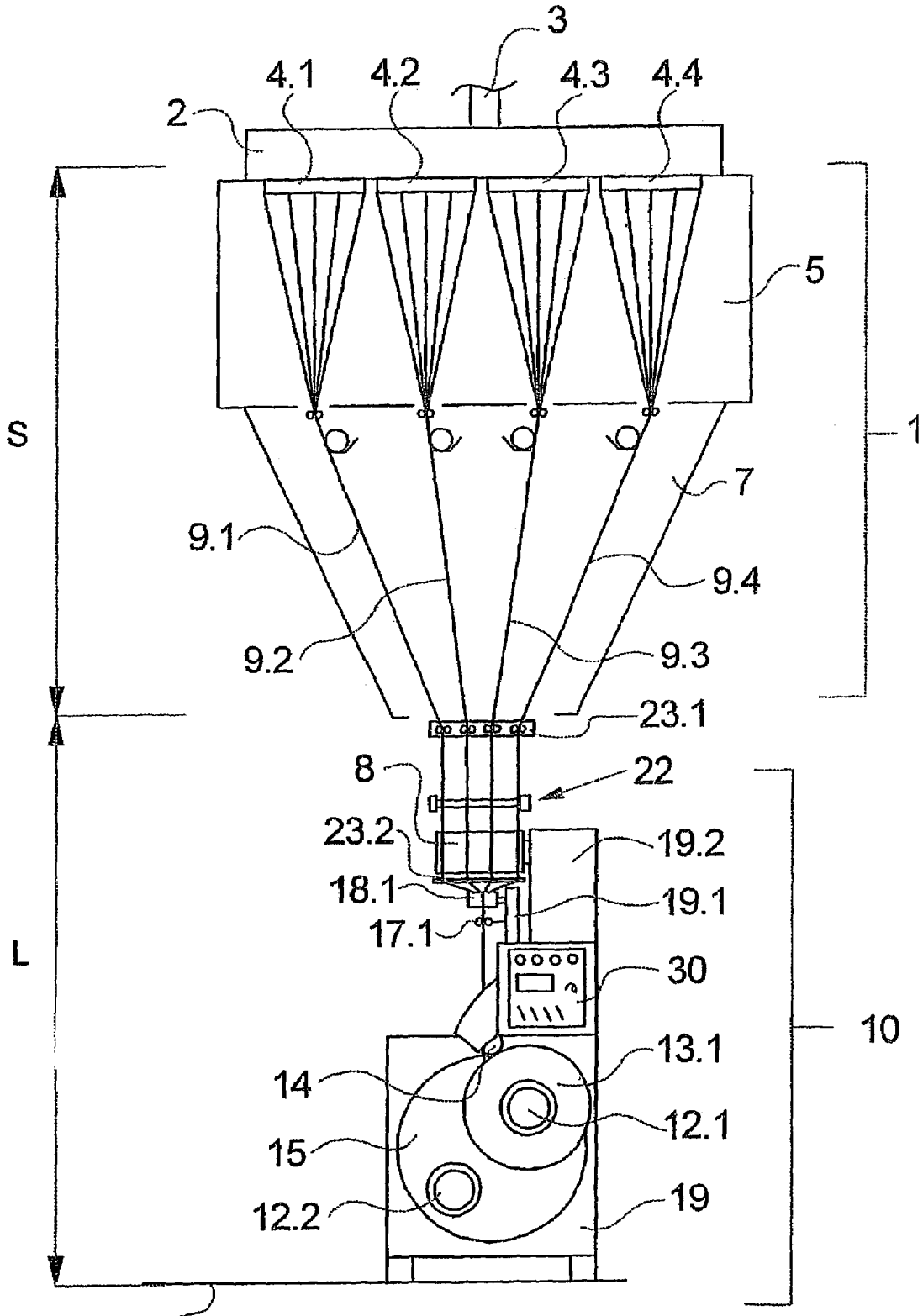
FIG. 2 is a schematic front view of the embodiment of FIG. 1.
Figure 3:
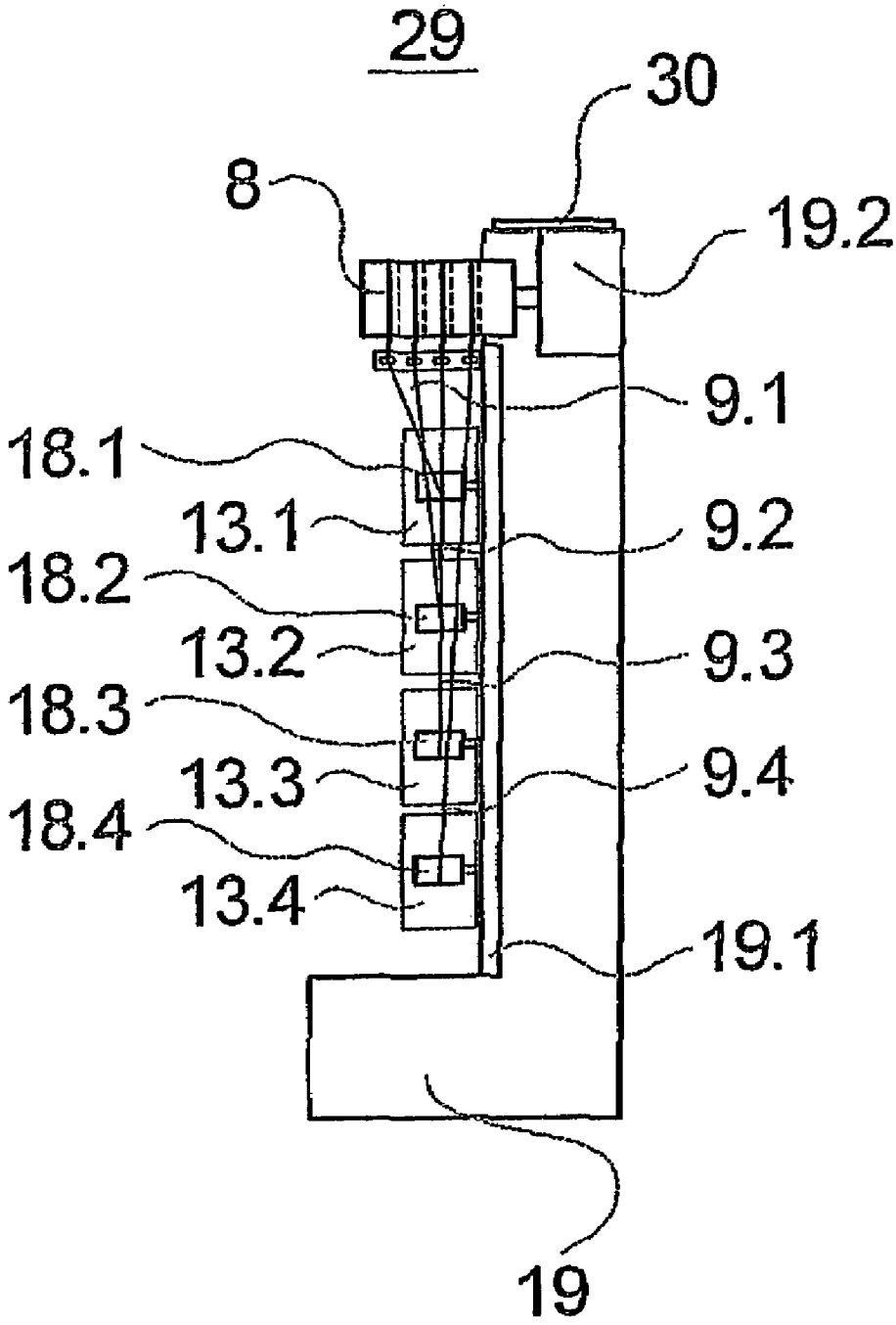
FIG. 3 is a schematic top view of the embodiment of FIG. 1.

FIGS. 1-3, illustrate several views of a first embodiment of the apparatus according to the invention. FIG. 1 is a side view of the apparatus, FIG. 2 a front view, and FIG. 3 a top view thereof. Unless express reference is made to one of the Figures, the following description will apply to all Figures.

The apparatus of the invention is composed of a spinning device 1 and a takeup device 10, with a withdrawal godet 8 being arranged in the transition zone between the spinning device 1 and the takeup device 10. The spinning device 1 includes a heated spin beam 2, which connects via a melt supply line 3 to a melt source not shown, for example, an extruder. In this arrangement, it is possible to associate a plurality of spinning devices to a common melt source. On its underside, the spin beam 2 mounts a plurality of spinnerets, 4.1, 4.2, 4.3, and 4.4. Both the arrangement of the spinnerets and the number of the spinnerets are exemplary. Thus, it is also possible to arrange a plurality of spinnerets in several rows or in a circle.

Each of the spinnerets 4.1-4.4 possesses a plurality of nozzle bores for extruding from a polymer melt that is supplied via the melt line, respectively a filament bundle of a multifilament yarn 9.1-9.4. Downstream of the spin beam 2, a cooling shaft 5 is provided, through which the filaments advance for purposes of cooling. To this end, a cooling air stream is preferably generated in the cooling shaft 5 by an airflow 6.

In the outlet region of the cooling shaft 5, a yarn lubrication device 20 and a plurality of yarn guides 21 are arranged for combining the filament bundles to the respective yarns 9.1-9.4. Arranged directly downstream of the cooling shaft 5 are a chute 7 and the withdrawal godet 8. The withdrawal godet 8 withdraws the yarns 9.1-9.4 from the spinnerets 4.1-4.4 substantially in a spinning plane, which is substantially vertical. On the outlet side of the cooling shaft 5, the yarns 9.1-9.4 are combined by yarn guides 21 and a yarn guide edge 23.1 from a yarn spacing as is determined by the spinning gauge to a smaller spacing for their treatment. The yarns 9.1-9.4 are then guided in spaced relationship for their treatment over the circumference of the withdrawal roll 8. Between the yarn guide edge 23.1 and withdrawal godet 8, a yarn collection device 22 is provided, through which the group of yarns advances to a suction system in the event of a yarn break. The yarn collection device 22 comprises a movable guide means and a suction system, which permit collecting the yarns 9.1-9.4 in the event of a yarn break. Such a yarn collection device is disclosed in EP 1 049 821 A1, the disclosure of which is herewith incorporated by reference.

Downstream of the spinning device 1, the takeup device 10 extends, which is oriented with its longitudinal axis in transverse relationship with the spinning plane of the group of yarns 9.1-9.4. The spinning device 1 and the withdrawal godet 8 are located in transverse relationship with the longitudinal axis of the takeup device 10 in the region of a front end 29 of the takeup device 10.

The axis of the withdrawal godet 8 is substantially horizontal and parallel to the spinning plane, and preferably, the yarn leaves the withdrawal godet 8 below an upper edge of the machine frame of takeup device 10. To be able to enclose the takeup device, it is also possible to arrange the withdrawal godet completely below the upper edge of the takeup device.

Distributed along its longitudinal axis, the takeup device 10 includes a plurality of winding positions 11.1-11.4. In each of the winding positions 11.1-11.4, one of the yarns 9.1-9.4 is wound to one of packages 13.1-13.4. To this end, a winding spindle 12.1 mounts a plurality of coaxially mounted tubes upon which the packages 13.1-13.4 are wound. The winding spindle 12.1 is driven such that a uniform takeup speed is available for winding the yarns 9.1-9.4. The winding spindle 12.1 is mounted in cantilever fashion on a package turret 15 for rotation parallel to the longitudinal axis. In spaced relationship therewith, the package turret 15 mounts a second winding spindle 12.2. The package turret 15 is rotatably supported on a machine frame 19, so as to permit guiding the winding spindles 12.1 and 12.2 alternately into a winding range and a doffing range. To this end, a drive is associated with the package turret 15. In the winding range, the winding spindle 12.1 or 12.2 cooperates with a contact roll 14, which lies against the circumference of the package 13.1-13.4 that are to be wound. The contact roll 14 is rotatably supported, preferably on a movable support that is, for example, pivotally connected to the machine frame 19.

To wind the yarns 9.1-9.4 in their respective winding positions 11.1-11.4 to packages 13.1-13.4, each winding position 11.1-11.4 is provided with a yarn traversing device 16, which reciprocates the yarn within a traverse stroke.

Upstream of the yarn traversing device 16, a frame section 19.1 of each of the winding positions 11.1-11.4 mounts respectively an inlet yarn guide 17.1-17.4 and a freely rotatable distributor roll 18.1-18.4. Preferably, each distributor roll 18.1-18.4 is formed by a smooth roll, which is supported for free rotation about an axle. Laterally adjacent the winding position 11.1, a frame section 19.2 mounts the withdrawal godet 8. To distribute the yarns 9.1-9.4 advancing over the circumference of withdrawal godet 8, a yarn guide edge 23.2 extends downstream of withdrawal godet 8, which causes the yarns to leave the withdrawal godet 8 along a parallel path which defines a substantially horizontal distribution plane. Subsequently, the yarns 9.1-9.4 advance over distributor rolls 18.1-18.4 to the winding positions 11.1-11.4. Thus, after leaving the withdrawal godet 8, the yarn 9.1 advances over the distributor roll 18.1 into the winding position 11.1. The advance of the yarns 9.2, 9.2, and 9.4 occurs accordingly via the distributor rolls 18.2, 18.3, and 18.4, which are successively arranged in the winding positions 11.2, 11.3, and 11.4.

The front end 29 of the takeup device 10 also serves as the operating side of the takeup device. The free end of the machine frame 19 mounts a control panel 30 above the free ends of the projecting winding spindles 12.1 and 12.2. The control panel 30 permits an operator operating all controllable actuators and operational sequences of both the takeup device 10 and the withdrawal godet 8. At the same time, a person is able to operate all devices in the region of front end 29 of the takeup device 10, which are arranged downstream of the chute 7 of spinning device 1. To this end, the outlet of chute 7 is preferably arranged above a service platform 24 at a height, which is less than about 250 cm. The overall height that is necessary for operating the devices downstream of the spinning device 1 is identified in FIGS. 1 and 2 by capital letter L. The overall height of the spinning device, which is identified by the letter S, represents the transition zone from a spacing between the yarns 9.1-9.4 for spinning to a spacing for treatment. The overall height S is essentially determined by the admissible angles of deflection of the yarns. In this connection, it is necessary to maintain as much as possible an angular range of about 7°. Thus, the overall height S is dependent both on the number of the yarns that are spun in the spinning device parallel in side-by-side relationship, and on the arrangement of the spinnerets. Thus, it is possible to arrange the spinnerets relative to one another in a single row or in double rows. It is also possible to place the spinnerets in a circular arrangement for obtaining an advantageous distribution of the melt.

At the start of the process, after an initial spinning and threading in the spinning device 1, the operator collects the yarns 9.1-9.4 at the outlet of chute 7 by means of a suction gun. By manually guiding the suction gun, which continuously advances the yarns to waste, the yarns 9.1-9.4 are threaded, one after the other, into the yarn guides of the yarn guide edge 23.1, the yarn collection device 22 and withdrawal godet 8, as well as on a yarn guide edge 23.2 downstream thereof. Subsequently, the yarns 9.1-9.4 are distributed to the individual distributor rolls 18.1-18.4. This can be done by manual guidance or by auxiliary devices as disclosed, for example, in EP 0 886 623 A1. However, it is also possible to arrange the distributor rolls 18.1-18.4 on a linear guideway, along which the distributor rolls can be moved to a threading position near the front end of the takeup device. In this instance, the distributor rolls would be moved to their respective operating position for distributing the yarns. After starting up the takeup device 10 and after threading the yarns 9.1-9.4 in the winding positions 11.1-11.4, the process is started.

The apparatus shown in FIGS. 1-3 is especially suited for producing from preoriented yarns partially oriented yarns (POY). The L-shaped configuration of the spinning device and takeup device permits distributing with advantage the yarns after their treatment to the takeup device in an inclined distributing plane transverse of a vertical spinning plane. This makes it possible to realize a very low overall height. The entire apparatus extends only over two tiers, with the lower tier accommodating the takeup device with all treatment devices, and the upper tier including the spinning devices with the melt sources, such as extruders.

Figure 4:
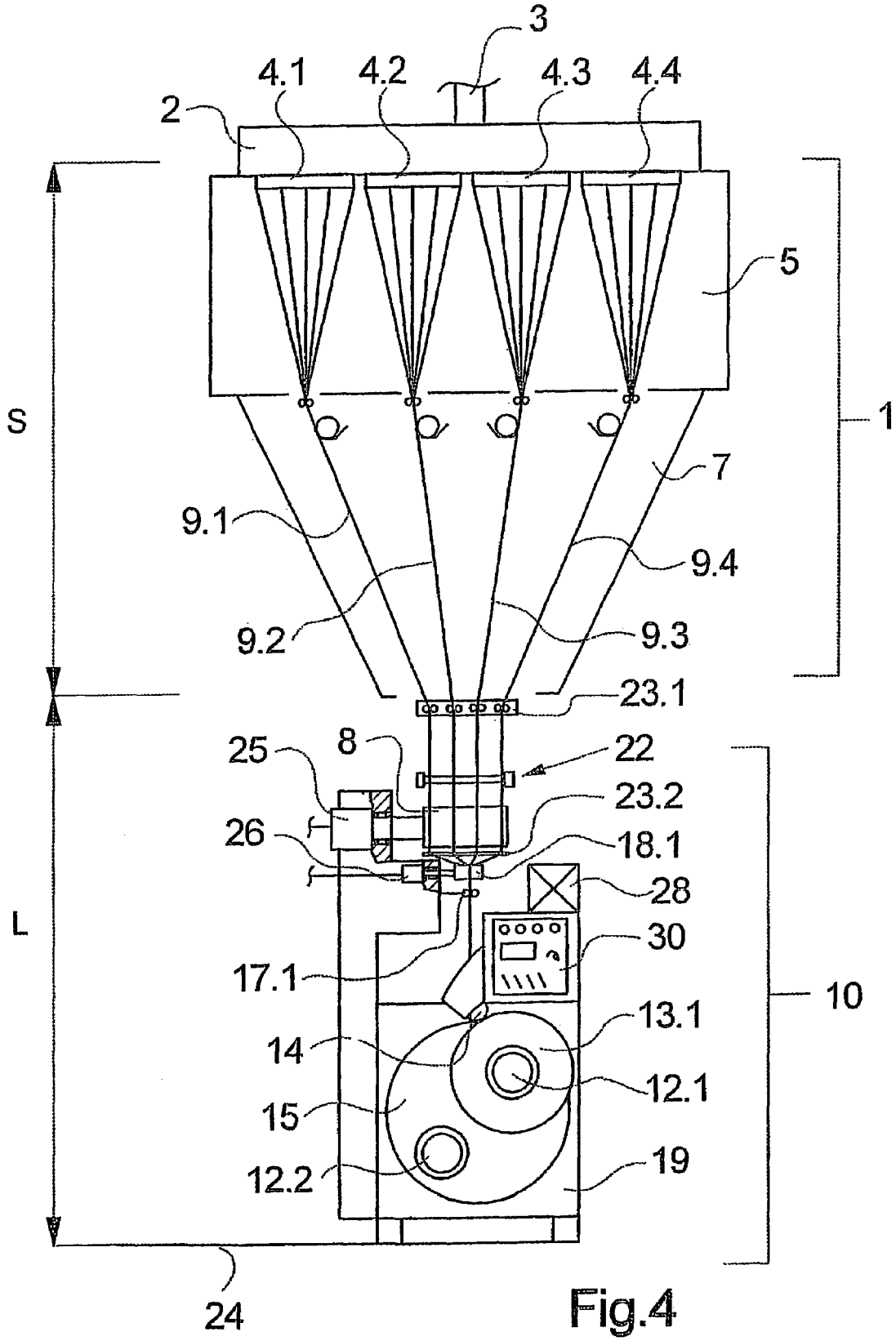
FIG. 4 is a schematic front view of a further embodiment of the apparatus according to the invention.

FIG. 4 is a schematic front view of a further embodiment of the apparatus according to the invention. The embodiment of the apparatus according to the invention is substantially identical with the foregoing embodiment, so that the foregoing description is herewith incorporated by reference and only differences are shown at this point. The components with the same function were provided with identical numerals.

The spinning device 1, the withdrawal godet 8, and the takeup device 10 are placed relative to one another in the previously described L-shaped configuration. FIG. 4 illustrates the operating side of the takeup device 10, from which an operator performs the insertion and threading of the yarns 9.1-9.4. The takeup device 10 is essentially identical with the foregoing embodiment, with the machine frame 19 mounting an electronic unit 28 above the yarn traversing device 16. Such a layout of the takeup device 10 is disclosed, for example, in EP 0 845 432 A1, whose disclosure is herewith incorporated by reference. On the side opposite to the electronic unit 28, the frame section 19.1 is rigidly connected to the machine frame 19 of the takeup device 10. The upper end of frame section 19.1 rotatably supports the withdrawal godet 8. The withdrawal godet 8 is driven by a godet drive 25. The supply and activation of the godet drive occurs via the electronic unit 28. To this end, the godet drive 25 is coupled with the electronic unit 28. Downstream of the withdrawal godet 8, the machine frame section 19.1 mounts a distributor roll for each yarn. The arrangement of the distributor rolls corresponds to the previously described embodiment, so that FIG. 4 shows only the first distributor roll 18.1. The distributor roll 18.1 and all other distributor rolls not shown connect to a drive 26. The distributor roll drive 26 drives the associated distributor roll at a predetermined circumferential speed. The supply and activation of the distributor roll drive 26 occur via the electronic unit 28. Thus, the distributor roll drive 26 is coupled with the electronic unit 28. This permits controlling from the control panel 30, the withdrawal godet 8 and distributor roller 18.1, as well as all other distributor rolls not shown.

The embodiment of the apparatus according to the invention as shown in FIG. 4 thus distinguishes itself by a high degree of integration. The apparatus is thus essentially formed by the spinning device 1 and the takeup device 10, with the takeup device 10 accommodating and electronically supplying all other devices for treating the yarns. A linkup thus occurs in a simple manner via the electronic unit 28.

In the embodiment shown in FIG. 4, it is possible to drive the distributor rolls individually, each by a drive, or jointly by a common drive. In the case of the individually driven distributor rolls, it is possible to perform individual yarn tension adjustments, in particular equalizations of yarn tensions for winding the yarns. In the case of a group drive of the distributor rolls, it is possible to adjust with advantage a differential speed for treating the yarns, which is operative between the withdrawal godet and the distributor rolls.

Figure 5:
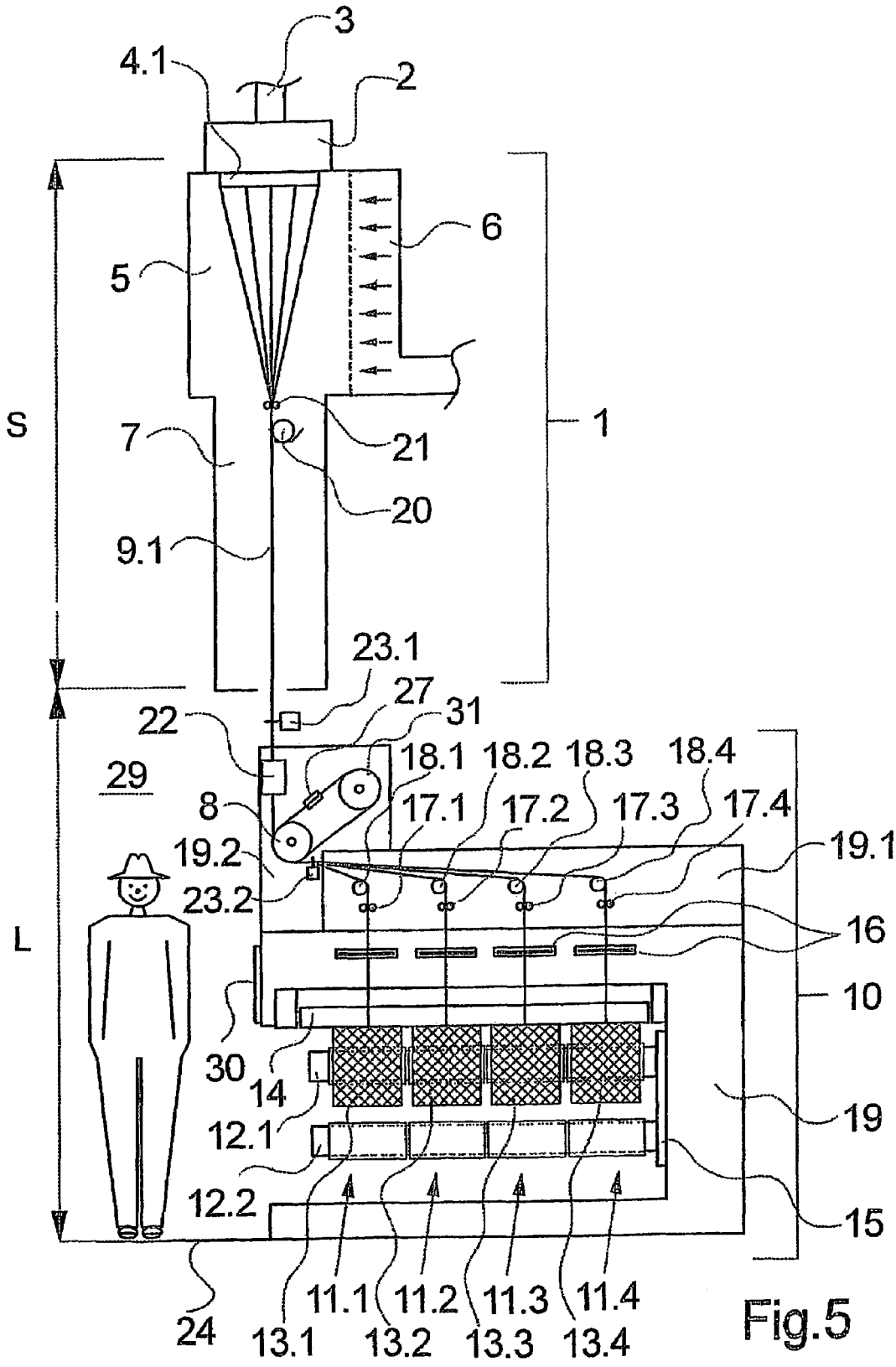
FIG. 5 is a schematic side view of a further embodiment of the apparatus according to the invention.

FIG. 5 illustrates a further embodiment of an apparatus according to the invention. The embodiment is essentially identical with the previously described embodiment of FIGS. 1-3. To this extent, the foregoing description with reference to FIGS. 1-3 is herewith incorporated by reference, and only the differences are described at his point.

FIG. 5 is a side view of the embodiment. The spinning device 1 is identical with the foregoing embodiment. Likewise, the takeup device 10 shows only differences in the layout of the machine frame. Thus, the machine frame section 19.2 mounts a second godet 31 adjacent the withdrawal godet 8. The withdrawal godet 8 and second godet 31 are rotatably supported in cantilever fashion on the machine frame section 19.2, with each of the godets 8 and 31 being driven by a drive. Between the withdrawal godet 8 and the second godet 31, an entanglement device 27 is arranged, through which the yarns 9.1-9.4 looping several times about the withdrawal godet 8 and the second godet 31 advance in one leg of their looping. After having been treated and after leaving the withdrawal godet 8, the yarns are distributed in accordance with the foregoing embodiments.

The embodiment of the apparatus according to the invention as shown in FIG. 5 thus differs by the treatment of the yarns before their takeup. Thus, the entangling that the yarns undergo in the entanglement device 27 before they leave the withdrawal godet, permits adjusting a yarn tension that is optimal for winding the yarns. It is likewise possible to build up greater withdrawal forces by the withdrawal godet 8 for removing the yarns 9.1-9.4 from the spinning device 1. In this connection, it is possible to make the withdrawal godet 8 and/or the second godet 31 heatable. There also exists the possibility of replacing the second godet 31 with a non-driven, freely rotatable guide roll. Basically, it is possible to supplement treatment of the yarns by additional devices not shown, such as, for example, additional godets, heaters, or entanglement devices.

The embodiments of the apparatus according to the invention as shown in FIGS. 1-5 are exemplary in their layout and the selection of the individual processing units. The invention also covers similar apparatus. While these apparatus differ in their layout and the selection of the individual processing units, they include the spinning device and the takeup device in an L-configuration in accordance with the invention.

Normally, a plurality of apparatuses according to the invention are set up to form a complete production line. In this connection, the L-shaped configuration of the apparatus is especially suited for obtaining a high integration. Thus, it is possible to make the upper sides of the takeup devices accessible to form, for example, a service platform for the spinning device. In additional, it is possible to realize in a simple manner central cable lines for the energy supply of the apparatus.

The invention claimed is:

1. An apparatus for spinning a plurality of multifilament yarns and winding the same into respective yarn packages, comprising a melt spinning device including a plurality of spinnerets for melt spinning a plurality of multifilament yarns in a downwardly extending side by side arrangement which defines a substantially vertical spinning plane, a takeup device for winding the advancing yarns onto respective bobbin tubes which are coaxially mounted at respective winding positions on a common longitudinally extending winding spindle which defines a longitudinal axis, a withdrawal godet mounted for rotation about a withdrawal axis and disposed below the spinning device for withdrawing the yarns from the spinnerets and advancing the same along a substantially horizontal distribution plane to the takeup device, wherein the substantially vertical spinning plane, and the withdrawal axis of the godet, are arranged in a transverse relationship with the longitudinal axis of the winding spindle, and wherein the apparatus further comprises a plurality of distributor rolls arranged above respective ones of the winding positions on the winding spindle for guiding the yarns from the withdrawal godet and along the distribution plane, and then downwardly to respective winding positions.

2. The apparatus of claim 1 wherein the winding spindle of the takeup device includes a free end which defines a front end of the takeup device, and wherein the spinning device further includes a delivery chute having an outlet through which the downwardly advancing yarns are delivered, and wherein the outlet of the chute and the withdrawal godet are positioned adjacent the front end of the takeup device.

3. The apparatus of claim 2 further comprising a service platform upon which an operator can stand and which is located adjacent the front end of the takeup device and so that the operator can reach the outlet of the chute.

4. The apparatus of claim 3 wherein the service platform is spaced not more than about 250 cm from the outlet of the chute.

5. The apparatus of claim 1 wherein the distributor rolls are rotatably driven individually or in groups.

6. The apparatus of claim 1 wherein a second godet is associated with the withdrawal godet so that the yarns may be looped about the withdrawal godet and the second godet before their delivery to the winding positions.

7. The apparatus of claim 6 further comprising an entanglement device arranged between the withdrawal godet and the second godet.

8. The apparatus of claim 6 wherein one of the withdrawal godet and the second godet is non driven.

9. The apparatus of claim 1 wherein the takeup device includes a machine frame upon which the winding spindle and the withdrawal godet are rotatably mounted.

10. The apparatus of claim 9 further comprising an electronic device for driving and controlling the withdrawal godet, and an electronic device for driving and controlling the takeup device, and wherein the two electronic devices are combined in a constructional unit of said machine frame.

11. The apparatus of claim 1 wherein the longitudinal axis of the winding spindle is substantially horizontal and substantially perpendicular to the spinning plane and the axis of the withdrawal godet.

12. The apparatus of claim 1 wherein the axis of the withdrawal godet is substantially horizontal and parallel to the spinning plane.

13. The apparatus of claim 1 wherein the distributor rolls are rotatably driven.

14. An apparatus for spinning a plurality of multifilament yarns and winding the same into respective yarn packages, comprising a melt spinning device including a plurality of spinnerets for melt spinning a plurality of multifilament yarns in a downwardly extending side by side arrangement which defines a substantially vertical spinning plane, a takeup device for winding the advancing yarns onto respective bobbin tubes which are coaxially mounted at respective winding positions on a common longitudinally extending winding spindle which defines a horizontal longitudinal axis which is substantially perpendicular to said vertical spinning plane, a plurality of distributor rolls arranged above respective ones of the winding positions, a withdrawal godet mounted for rotation about a generally horizontal withdrawal axis which is generally parallel to the vertical spinning plane, with the withdrawal axis disposed below the spinning device for withdrawing the yarns from the spinnerets and advancing the same along a generally horizontal distribution plane leading from the withdrawal godet to respective ones of the distributor rolls and then downwardly to the associated winding positions.

15. The apparatus of claim 14 wherein the distributor rolls are mounted for rotation about axes which are parallel to the withdrawal axis of the withdrawal godet.

16. The apparatus of claim 15, wherein the withdrawal godet and each of the distributor rolls are driven by respective drives which are connected to a common control panel.

* * * * *